US006875405B1

(12) United States Patent
Mathus et al.

(10) Patent No.: US 6,875,405 B1
(45) Date of Patent: Apr. 5, 2005

(54) TUBE RACK

(75) Inventors: Gregory Mathus, Concord, MA (US); Daniel J. Seguin, Amherst, NH (US); Victor A. Torti, Brookline, NH (US)

(73) Assignee: Matrix Technologies Corporation, Hudson, NH (US)

( * ) Notice: Subject to any disclaimer, the term of this patent is extended or adjusted under 35 U.S.C. 154(b) by 0 days.

(21) Appl. No.: 09/457,796

(22) Filed: Dec. 9, 1999

Related U.S. Application Data

(63) Continuation-in-part of application No. 09/241,490, filed on Feb. 1, 1999, now abandoned.

(51) Int. Cl.[7] ..... B01L 3/00; B01L 9/00

(52) U.S. Cl. ..... 422/102; 422/104; 422/297; 435/288.3; 435/288.4; 435/305.1; 435/809; 220/831; 220/836; 220/840; 220/842; 220/315; 220/832; 206/446; 206/557; 206/560; 206/562; 206/563

(58) Field of Search ..... 220/831–832, 220/836, 840, 842, 315, 244, 780, 781, 324; 435/288.3, 288.4, 305.1, 809; 422/102, 104, 297; 206/446, 552, 560, 562–563

(56) References Cited

U.S. PATENT DOCUMENTS

| | | | | | |
|---|---|---|---|---|---|
| 3,643,812 | A | | 2/1972 | Mander et al. | |
| 3,744,665 | A | | 7/1973 | Spoto | |
| 3,860,141 | A | * | 1/1975 | Hawk | 220/831 |
| 3,871,832 | A | | 3/1975 | Leblanc | |
| 4,040,234 | A | | 8/1977 | Stockdale et al. | |
| 4,238,049 | A | | 12/1980 | Lehmann et al. | 220/331 |
| 4,541,992 | A | * | 9/1985 | Jerge et al. | 422/300 |
| 4,577,760 | A | | 3/1986 | Rainin et al. | |
| 4,599,314 | A | | 7/1986 | Shami | |
| 4,643,303 | A | | 2/1987 | Arp et al. | |
| 4,728,504 | A | | 3/1988 | Nichols | |
| 4,783,321 | A | | 11/1988 | Spence | |
| 4,798,292 | A | | 1/1989 | Hauze | |
| 4,854,475 | A | * | 8/1989 | Riihimaki et al. | 206/369 |
| 4,925,630 | A | | 5/1990 | Grunwald | |
| 4,942,271 | A | * | 7/1990 | Corsi et al. | 174/101 |
| 4,963,493 | A | | 10/1990 | Daftsios | |
| 4,967,924 | A | * | 11/1990 | Murofushi et al. | 220/3.8 |
| 5,080,232 | A | | 1/1992 | Leoncavallo et al. | |

(Continued)

FOREIGN PATENT DOCUMENTS

| | | |
|---|---|---|
| CH | 664 094 A5 | 2/1988 |
| DE | 198 52 165 A1 | 5/2000 |
| EP | 0 754 496 A1 | 1/1997 |

*Primary Examiner*—Lyle A. Alexander
*Assistant Examiner*—LaToya I. Cross
(74) *Attorney, Agent, or Firm*—Gauthier & Connors

(57) ABSTRACT

A tube rack comprises a base having an array of vertical openings extending therebetween, the openings being configured and dimensioned to receive a plurality of tubes, with the upper ends of the tubes being accessible at the top surface. The base includes base sidewalls that each include a co-axial trunnion extending from the associated sidewall. The tube rack also includes a rotatable and removable cover having a front wall, a back wall and first and second sidewalls, wherein the first and second side walls each include an associated notch open on a bottom surface thereof to allow the cover to be lowered onto the base, such that each of the notches rests on its associated trunnion and may be (i) vertically raised from its closed position on the trunnions and (ii) rotated about the trunnions from its closed position to allow access to the array of openings, wherein each of the notches includes a trunnion travel surface and a ledge surface and the ledge surface engages its associated trunnion to limit rotation of the cover beyond its full cover position. Each of the openings comprises a plurality of support pads positioned within the opening to vertically support the tube within its associated opening. Each of the pads includes a chamfered concave surface that supportably engages the tube, while providing flow paths through which air may pass through the openings adjacent to the tube.

13 Claims, 12 Drawing Sheets

U.S. PATENT DOCUMENTS 5,098,676 A 3/1992 Brooks, Jr.
5,228,584 A * 7/1993 Williams, Jr. ..... 220/3.8
5,364,592 A 11/1994 Lewis et al.
5,415,846 A 5/1995 Berry, Jr.
5,433,929 A * 7/1995 Riihimaki et al. ..... 422/297
5,579,929 A * 12/1996 Schwartz ..... 211/74
5,788,929 A 8/1998 Nesti
5,863,507 A 1/1999 James
5,935,524 A 8/1999 Bass et al.
5,993,745 A * 11/1999 Laska ..... 422/104
5,996,818 A * 12/1999 Boje et al. ..... 211/74
6,019,225 A * 2/2000 Kalmakis et al. ..... 206/563
6,138,686 A * 10/2000 Yuhara ..... 132/293
6,138,863 A * 10/2000 Aiken ..... 220/819
6,186,357 B1 * 2/2001 Kyle ..... 220/841
6,395,234 B1 * 5/2002 Hunnell et al. ..... 422/101

* cited by examiner

TUBE RACK

CROSS REFERENCE TO RELATED APPLICATIONS

This application is a continuation-in-part (CIP) of application designated Ser. No. 09/241,490, filed Feb. 1, 1999 now abandoned and entitled "Tube Rack". This application is hereby incorporated by reference.

BACKGROUND OF THE INVENTION

The present invention relates to test tube racks, and in particular to a tube rack having a multi-positional cover, wherein the rack is capable of receiving a variety of different tube styles and sizes.

Conventional covered test tube racks suffer from various disadvantages that limit their usage under varying laboratory and shipping conditions. For example, some racks lack a mechanism for securing the covers in their closed positions, thus presenting a danger that the cover may be inadvertently opened during shipment. Other covers are permanently hinged to the rack bases, which precludes or at least significantly limits their usage with robotic test equipment.

The present invention either obviates or at least significantly minimizes the above described problems by providing a test tube rack with a cover that may be locked in its closed position for shipment from one location to another, while it may be vertically removed from the rack base by robotic test equipment, and while it may be manually opened and closed while remaining pivotally connected to and supported by the rack base.

Other features of the invention include its capability of being used with a variety of different test tube types and sizes.

SUMMARY OF THE INVENTION

Briefly, according to the present invention, a tube rack comprises a base with an array of vertical openings configured and dimensioned to receive a plurality of tubes, with the upper ends of the tubes being accessible at the top surface. The base includes base sidewalls that each include a co-axial trunnion extending from the associated sidewall. The tube rack also includes a rotatable and removable cover having a front wall, a back wall and first and second sidewalls, wherein the first and second sidewalls each include an associated notch open on a bottom surface thereof to allow the cover to be lowered onto the base, such that each of the notches rests on its associated trunnion and may be (i) vertically raised from its closed position on the trunnions and (ii) rotated about the trunnions from its closed position to allow access to the array of openings. Each of the notches includes a trunnion travel surface and a ledge surface and the ledge surface engages its associated trunnion to limit rotation of the cover beyond its full cover position.

Each of the openings comprises a plurality of support pads positioned within the opening to vertically support the tube within its associated opening. Each of the pads preferably includes a chamfered concave surface that supportably engages the tube, while providing flow paths through which air may pass through the openings adjacent to the tube.

The tube rack also comprises first and second slide latches each having a lengthwise tongue. The base includes first and second base sidewalls that each include a slide surface comprising a lengthwise groove that slidably mates with one of the lengthwise tongues of an associated one of the slide latches, such that each of said slide latches moves lengthwise over its associated slide surface between latched and unlatched positions.

Advantageously, the rack of the present invention provides a convenient tube holder with a cover than can be easily manipulated by automated handling equipment.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
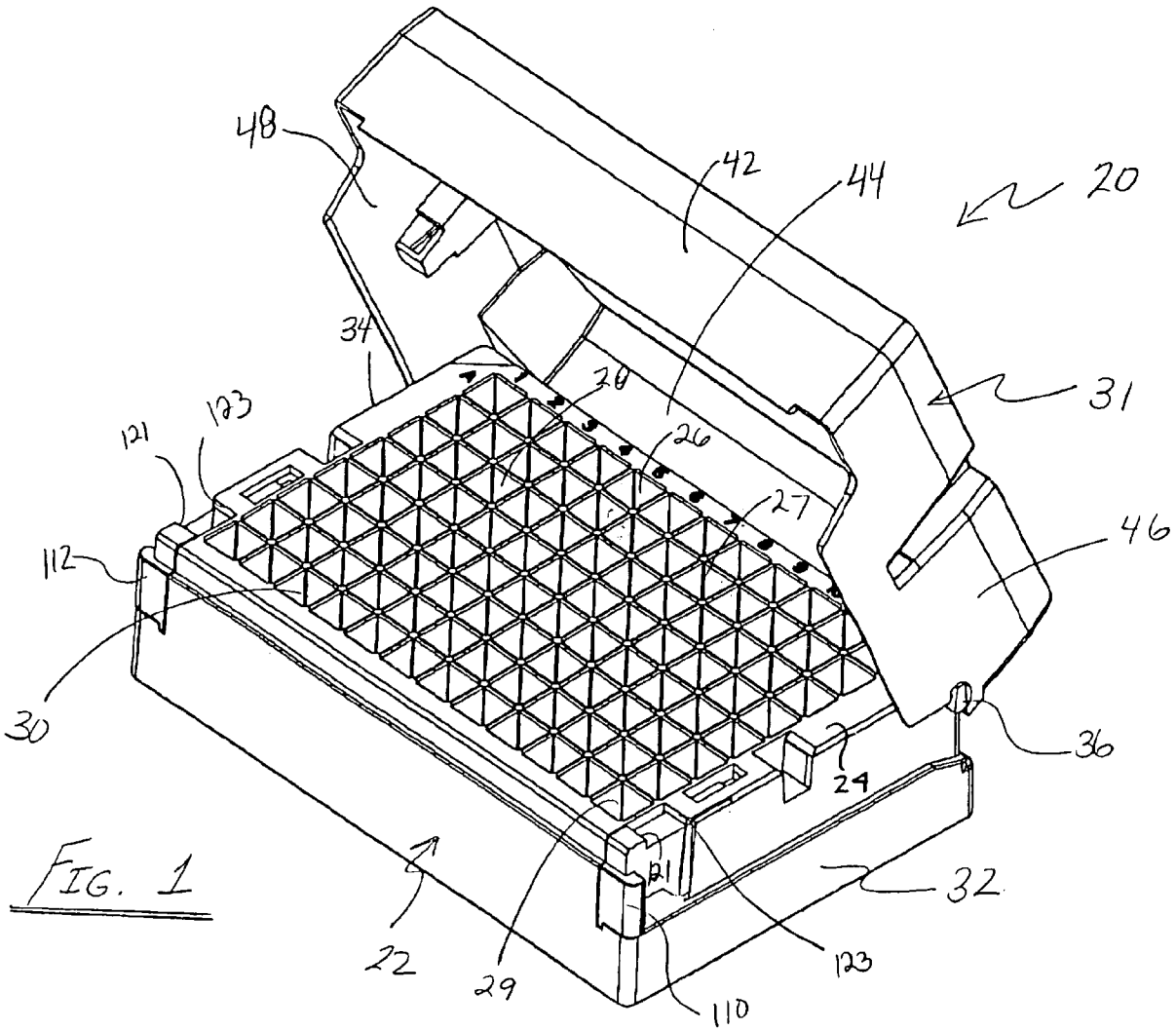
FIG. 1 is a perspective view of a tube rack having a cover in a partial open position above a base.

FIG. 1 is a perspective view of a tube rack 20 according to the present invention. The tube rack comprises a base 22 having an array of vertical openings 26–30. The rack 20 also includes a rotatable and removable cover 31 that cooperates with the base 22. As shown, the cover 31 is in a partial open position above the base 22.

Figure 2:
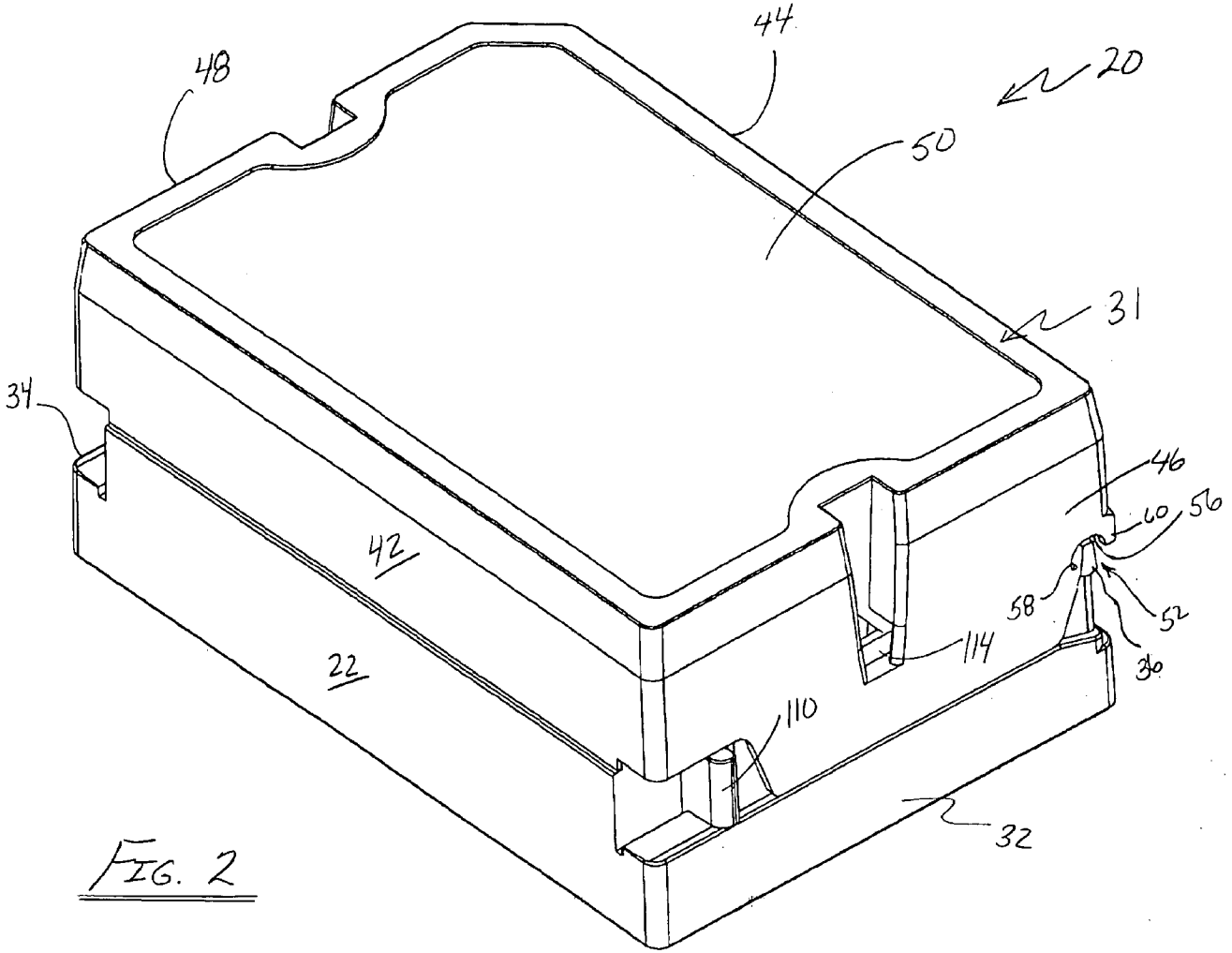
FIG. 2 is a perspective view of the tube rack with the cover in a closed position over the base.

FIG. 2 is a perspective view of the tube rack 20 with the cover 31 in a closed position over the base 22.

Figure 3:
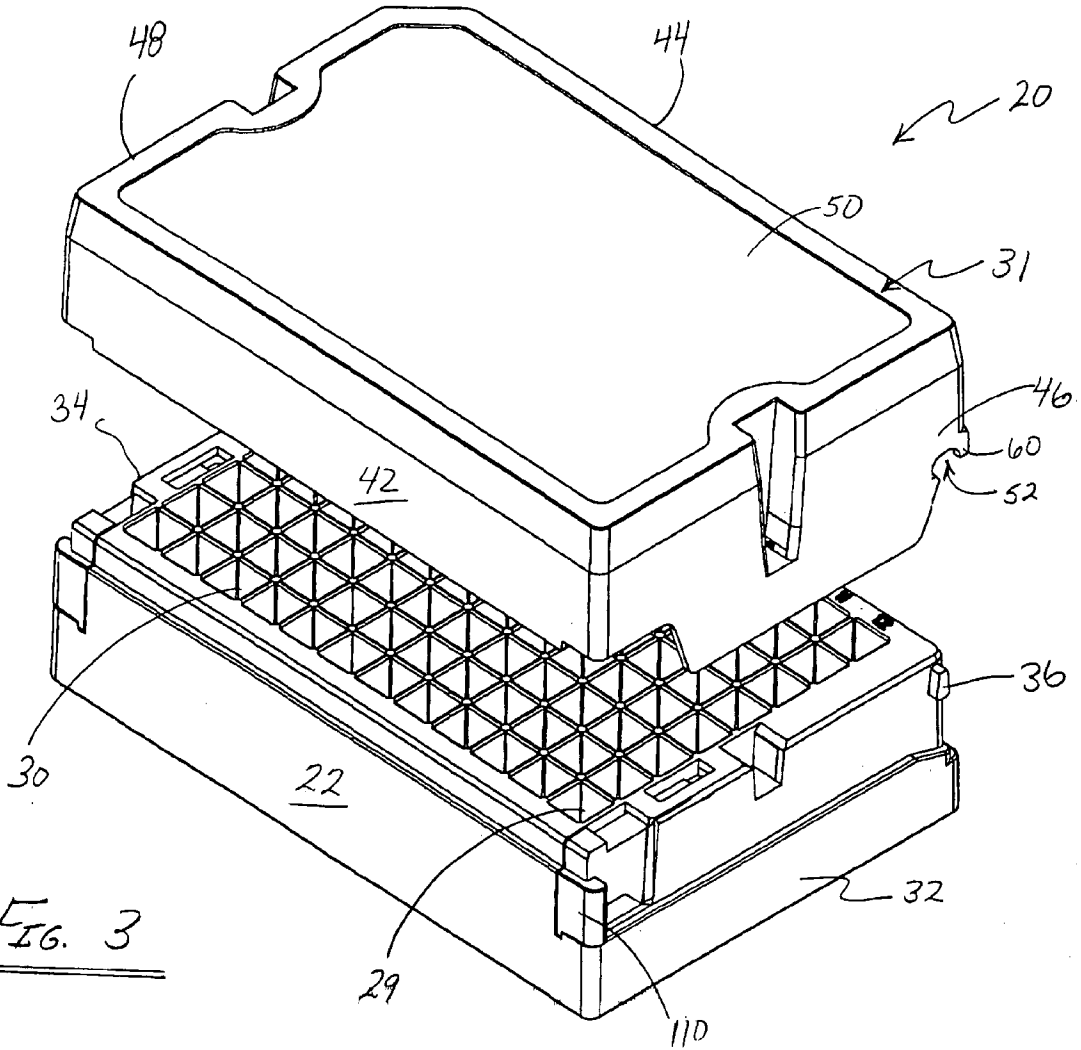
FIG. 3 is a perspective view of the tube rack with the cover removed from the base.

FIG. 3 is a perspective view of the tube rack with the cover removed from the base.

Referring again to FIG. 1, the openings 26–30 are configured and dimensioned to receive a plurality of tubes (not shown), with upper ends of the tubes being accessible at the top surface 24. The base 22 also includes sidewalls 32, 34. Each of the sidewalls 32, 34 includes an associated co-axial trunnion 36, 38, respectively, extending from its associated sidewall. Trunnion 38 is not visible in the FIG. 3.

Figure 4:
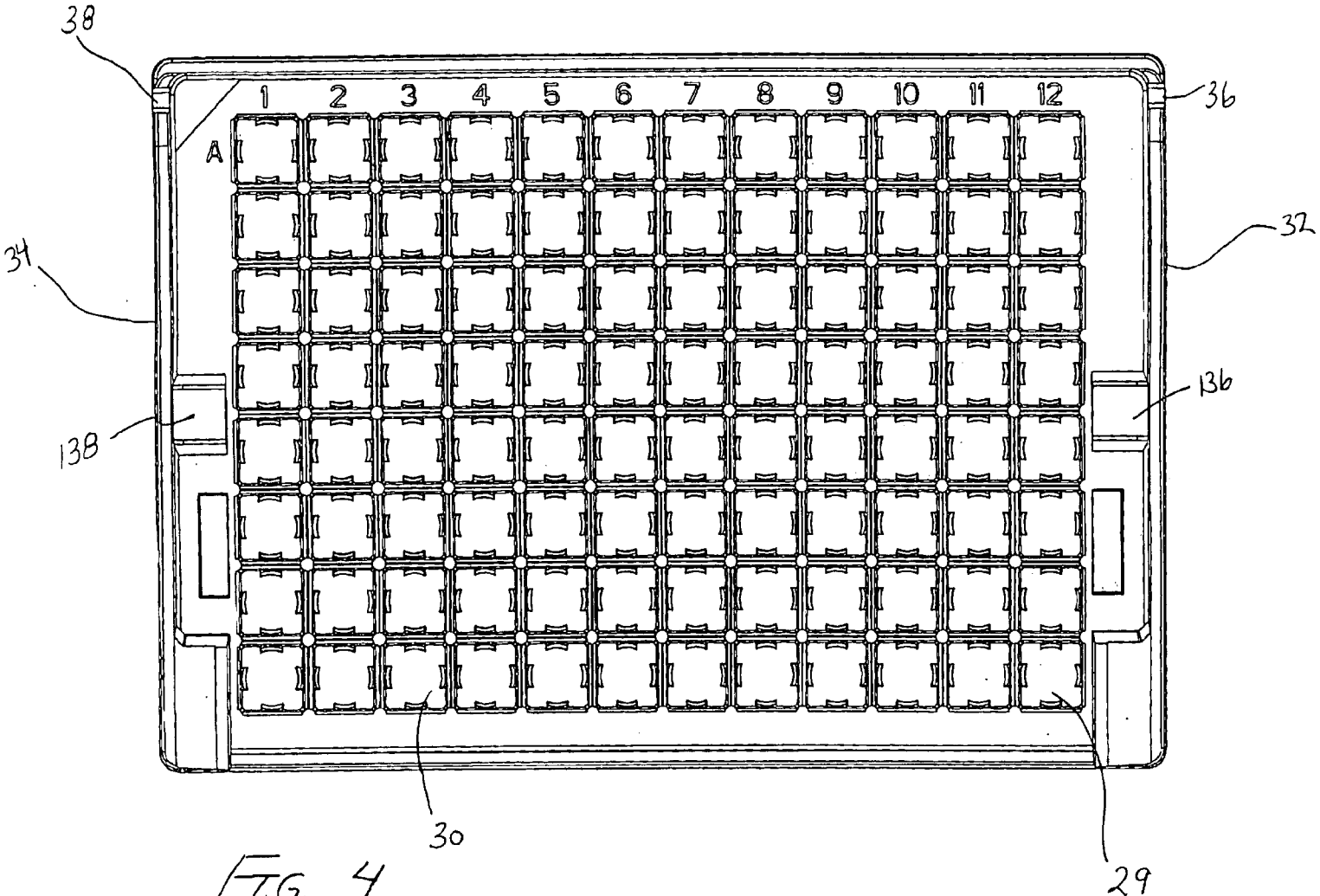
FIG. 4 is a top view of the base.

FIG. 4 is a top view of the base 22 illustrating the co-axial relationship of the trunnions 36, 38.

Referring to FIGS. 1–3, the rotatable and removable cover 31 includes a front wall 42, a back wall 44, first and second side walls 46, 48 respectively, and a top surface 50. The first and second side walls 46, 48 each include an associated notch 52, 54 having an open bottom surface to allow the cover to be lowered onto the base. Each of the notches is wide enough to allow the notch to rest on its associated trunnion. Each of the notches rests on its associated trunnion and from this position the cover may be (i) vertically raised from its closed position or (ii) rotated about the trunnions between its closed position and a full open position to allow access to the array of openings.

Figure 5:
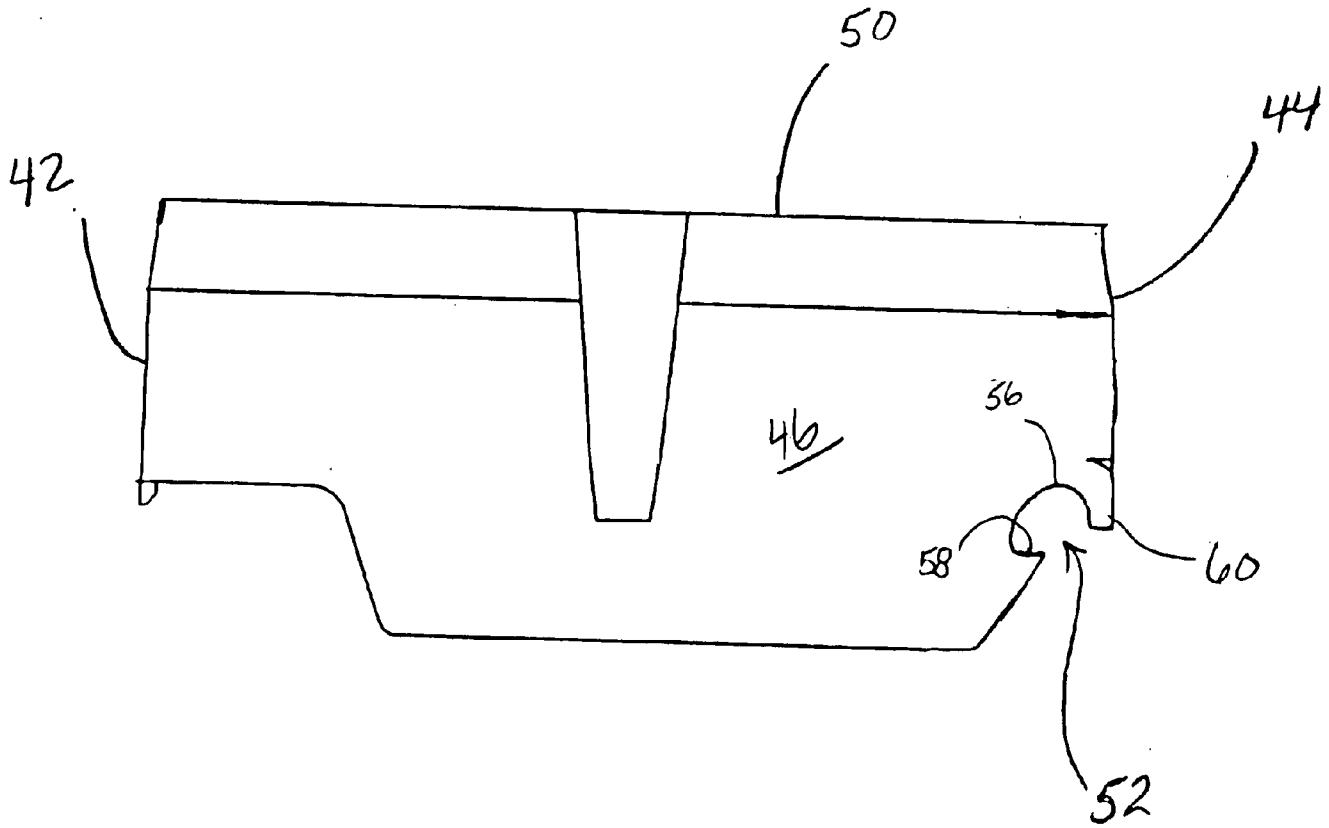
FIG. 5 is a side view of the cover.

FIG. 5 is a side view of the cover illustrating the first sidewall 46. The notch 52 includes a trunnion travel surface 56 and a ledge surface 58. The notch 54 (not shown) located in the second sidewall 48 (not shown) includes a similar trunnion travel surface and ledge surface as shown in FIGS. 2 and 5. The details of the trunnion travel surface and the ledge surface shall now be discussed.

Figure 6:
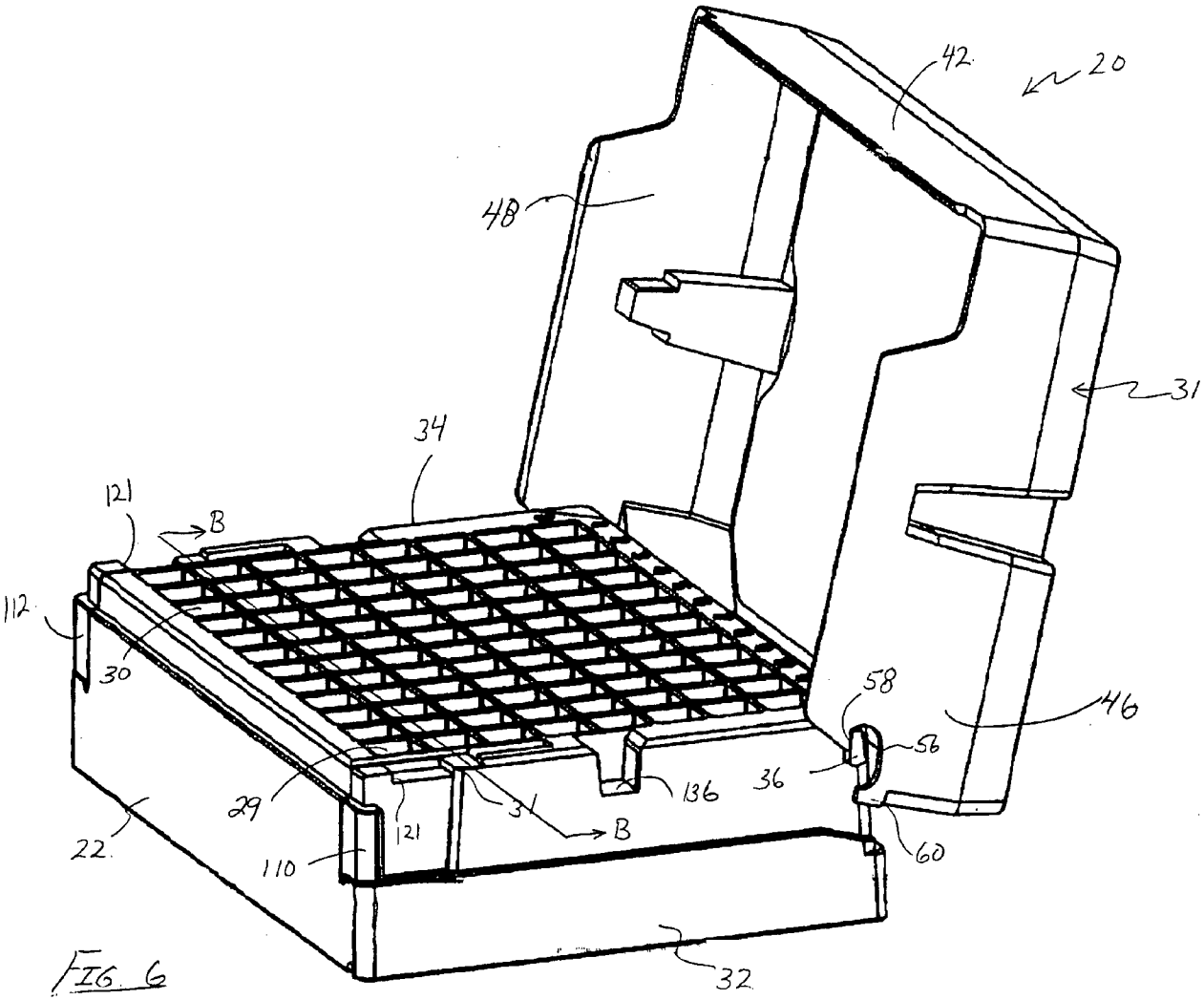
FIG. 6 is a perspective view illustrating the cover in the full open position over the base.

Referring to FIGS. 1, 2 and 5, to move the cover 31 between the open and closed positions, the cover 31 is rotated relative to the base 22 such that the trunnion travel surface 56 slides over the top surface of its associated trunnion. As the cover 31 is rotated to the open position, the ledge surface 58 engages/abuts against its associated trunnion to prevent rotation of the cover 31 beyond the full open position. FIG. 6 is a perspective view illustrating the cover in the full open position over the base. Notably, the engagement/abutment of the ledge surface 58 and the trunnion 36 prevents rotation of the cover 31 beyond the full open position. In addition, in the full open position the cover 31 can not be removed from the base 22. Specifically, the cover also includes a first tab 60 that extends from the corner formed by the backwall 44 and the first sidewall 46 of the cover, and a second tab (not shown) that extends from the corner formed by the intersection of the back wall and the second sidewall 48. When the cover has been rotated into the full open position, the tabs extend horizontally below their associated trunnion. In this position the tabs and the ledge surface act to lock the cover to the base. That is, the tabs (e.g., tab 60) prevents the cover from being vertically removed, while the ledge surface (e.g., ledge surface 58) prevents the cover from being horizontally removed from the base when it is in the full open position.

Figure 7:
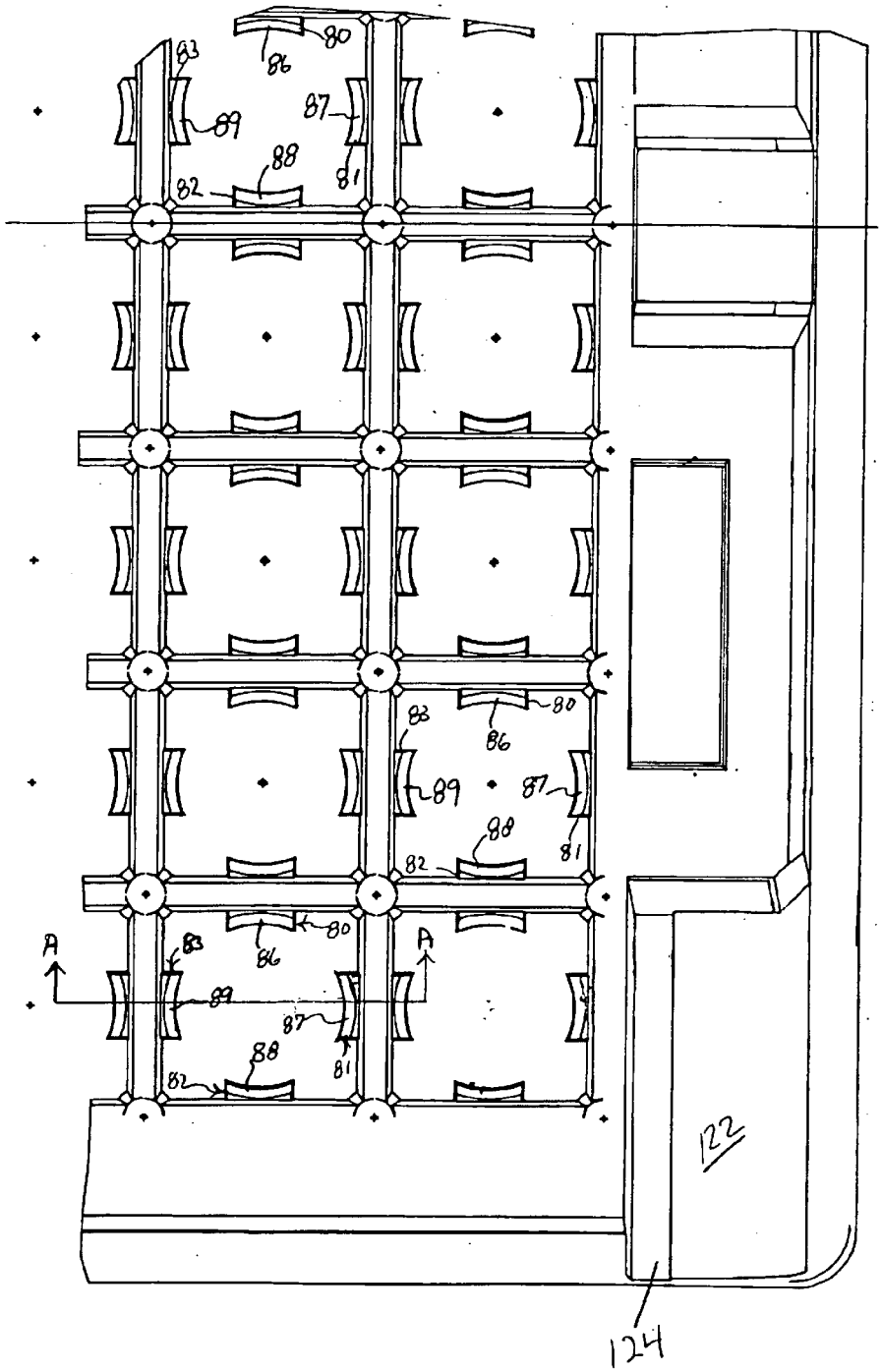
FIG. 7 is a top view of a portion of the base unit illustrating several of the plurality of openings.

FIG. 7 is a top view of a portion of the base unit illustrating several of the plurality of openings. Each of the openings includes a plurality of rigid support pads 80–83 to vertically support a tube placed therein. Each of the pads 80–83 comprises preferably a chamfered concave surface 86–89 respectively, that supportably engages the tube within the opening. Significantly, each of the pads 80–83 are sized to provide sufficient support to the tube and withstand downward forces on the pads when a cover (not shown) is placed over the tubes in the rack. An example of a cover is disclosed in co-pending application designated Ser. No. 09/195,326 entitled "Closure Device for Laboratory Receptacles", assigned to the assignee of the present invention. This application is hereby incorporated by reference. The pads engage a portion of the tube exterior, thus leaving air flow paths open between the bottom and top of the base. Arranging the pads in this manner allows air to be passed along exterior surfaces of the tubes to thaw, cool or heat the contents of the tubes while still in the tube rack 20. In an alternative embodiment, rather than a chamfered concave surface, the pad surface may be non-chamfered (e.g., vertical) and/or non-concave (e.g., straight).

Figure 8:
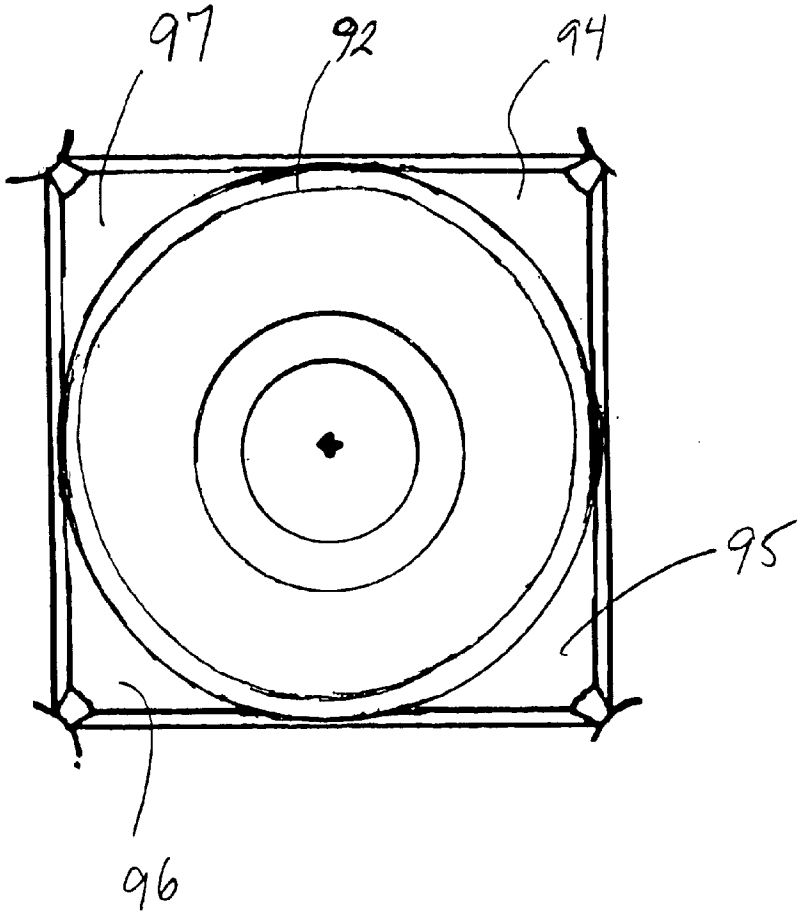
FIG. 8 is a top view of a single opening populated with a tube.

FIG. 8 is a top view of a single opening populated with a tube 92. Notably, there are air flow paths 94–97 in corners of the tube opening that pass from the top of the base to the bottom of the base.

Figure 9:
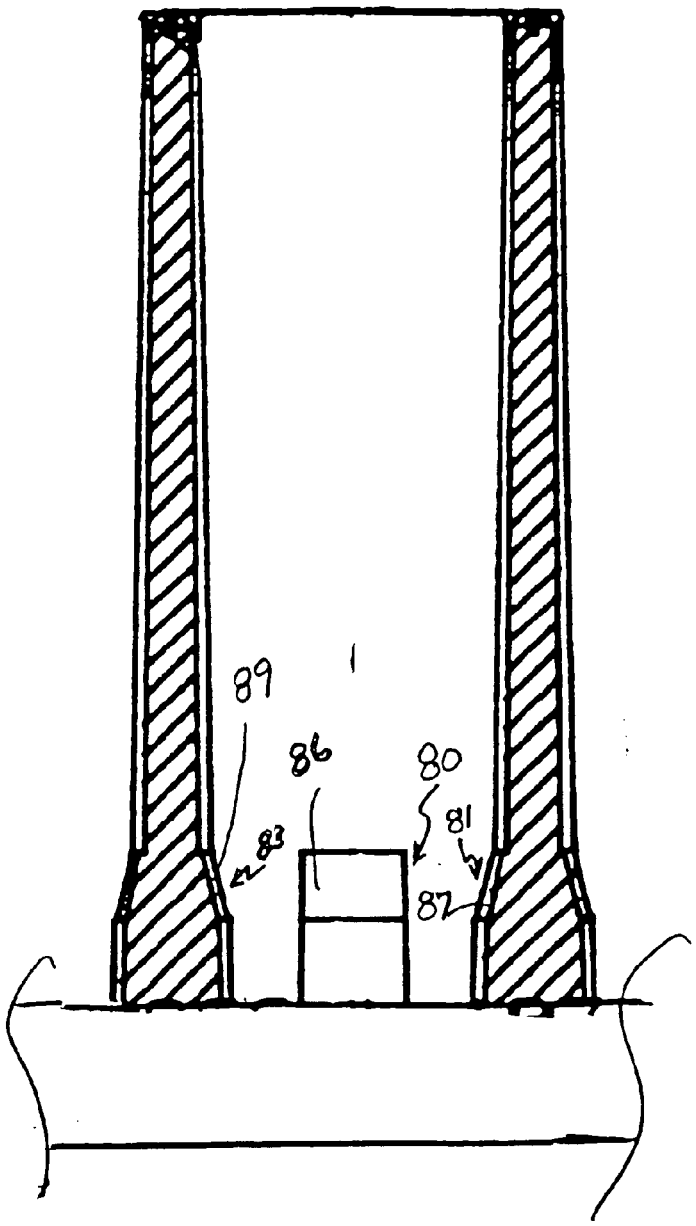
FIG. 9 is a sectional view taken along line A—A in FIG. 7 to illustrate the depth of pads within the opening.

FIG. 9 is a sectional view taken along line A—A in FIG. 7 to illustrate the depth of pads within the opening. In an alternative embodiment, it is contemplated that the pads may be located in the corners, so the air flow paths are located along the sidewalls rather than in the corners.

Figure 10:
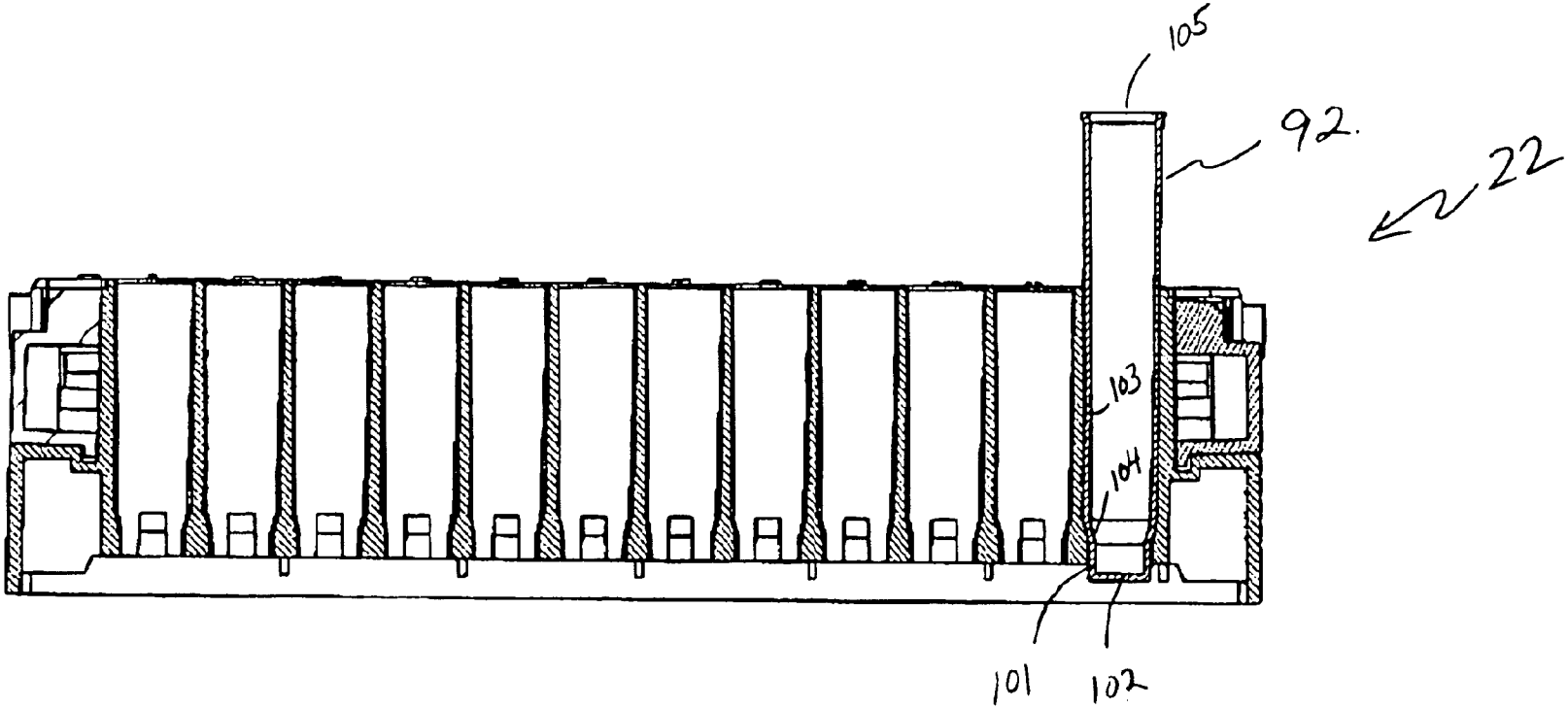
FIG. 10 is a sectional view of the base taken along line B—B shown in FIG. 6.

FIG. 10 is a sectional view of the base 22 taken along line B—B shown in FIG. 6. Notably, an opening within the base is populated with the tube 92. The tube includes an enclosed sidewall that includes a plurality of segments having different cross sections. The segments include a first cylindrical sidewall segment 101 integral with tube bottom surface 102 and a second cylindrical sidewall segment 103. The segments also include a truncated conical segment 104 located between the first and second cylindrical sidewall segments 101, 103, and having an increasing diameter closer to the open top 105 of the tube. The tube is lowered into the opening until the truncated conical segment 104 of the tube rest against the chamfered concave surfaces of the support pads such that the tube is supportably engaged within the opening.

Referring again to FIG. 1, the tube rack 20 also includes slide latches 110, 112 that are used to lock the cover 31 to the base 22 in the closed position. As shown in FIG. 1, the slide latches are in an outward position, which allows the cover to be rotated from the closed position towards the full open position or lifted off vertically. FIG. 2 illustrates the rack with the latches 110, 112 slid into an inward position to lock the cover to the base. The latch 112 can not be seen in this view since it has been slid inward. Each of the latches includes a finger 114, 116 respectively that prevents the cover 31 from being raised when the associated latch is in the inward position. Finger 116 can not seen in this view.

Figure 11B:
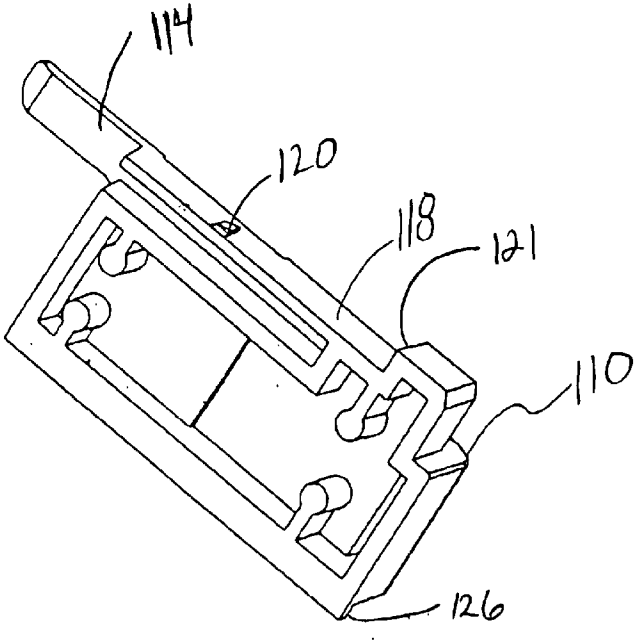
FIGS. 11A and 11B are perspective views of a sliding latch.
Figure 11A:
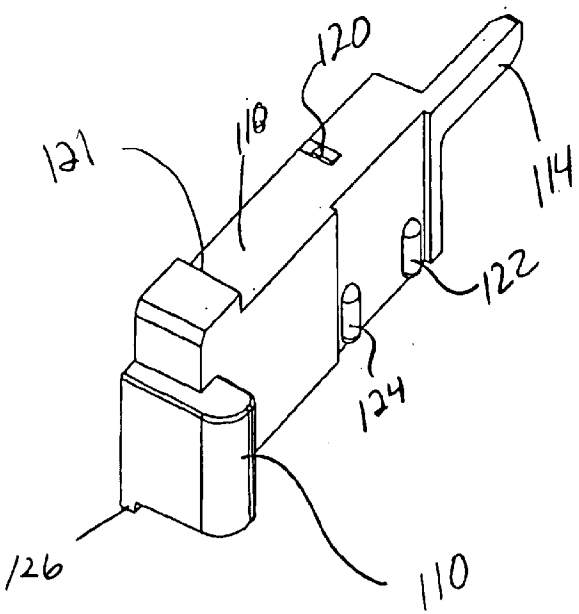

FIG. 11A is a perspective view of the latch 110. The latch includes a top surface 118 having a projection 120 that provides a detent so the latch is not withdrawn from the base, unless a force in excess of a predetermined amount is used. Not only does this projection 120 make it difficult for a user to withdraw the latch 110 too far, it also ensures that automated handling equipment can not withdraw the latch too far (assuming of course that the automated handling equipment does not use more than the predetermined amount of force). The latch 110 also includes sidewall projections 122, 124 that assist in maintaining the latch in its open or closed position. That is, when the latch 110 is in the open position sidewall projection 122 ensures that the latch does not slide inward in the absence of sufficient force by a user or automated handling equipment. When the latch is in the closed position to secure the cover to the base, sidewall projection 124 prevents the latch from sliding outward (i.e., open) in the slide in the absence of the requisite amount of withdrawal force by a user or automated handling equipment. The latches also each include a stop 121 that makes face-to-face contact with a base wall surface 123 (FIG. 1).

FIG. 11B is a perspective view of the opposite side of the latch 110 illustrated in FIG. 11A.

Referring again to FIG. 7, it should be noted that the latch 110 is not shown in this view. However, this view does illustrate that the base 22 includes a slide surface 122 comprising a groove 124 that receives a matching tongue 126 (FIGS. 11A and 11B) located on the latch 110 (FIGS. 11A and 11B). The latch 110 slides over the surface 122.

Figure 12:
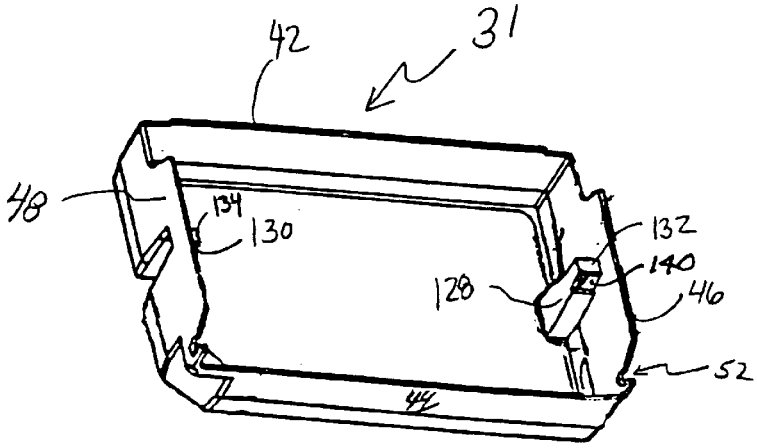
FIG. 12 is a perspective view of the underside of the cover.

FIG. 12 is a perspective view of the underside of the cover 31. The cover includes first and second bosses 128, 130 located along sidewalls 46, 48 respectively. Each boss includes an associated boss support surface 132, 134 that rest on base support surface 136, 138 (see FIG. 4) respectively. Each boss also includes a finger passage (e.g., 140) through which its associated latch finger (e.g., 114—FIGS. 2, 11A and 11B) passes to lock the cover in the closed position (see FIG. 2). Along with providing a mechanism for locking the cover to the boss, the bosses also provide support for the sidewalls 46, 48.

An additional feature of the tube rack of the present invention is that the shape of the cover and base units allows the racks to be stacked atop one another.

Although the present invention has been shown and described with respect to several preferred embodiments thereof, various changes, omissions and additions to the form and detail thereof, may be made therein, without departing from the spirit and scope of the invention.

What is claimed is:

1. A tube rack comprising:

a base having a top surface and oppositely facing side walls, said top surface being subdivided into an array of tube-receiving openings, each of said side walls having a trunnion protruding outwardly therefrom, with said trunnions being aligned coaxially; and a cover having oppositely facing side walls with notches in said side walls, said notches being defined by trunnion travel surfaces extending between ledge surfaces and tabs spaced one from the other at the entrance to said notches, said cover being configured and dimensioned to be seated on said base in a closed position enclosing said top surface, with said trunnions received in said notches and in contact with said trunnion travel surfaces, the spacing between said ledge surfaces and said tabs relative to the external dimensions of said trunnions being such as to permit unimpeded vertical movement of said cover between said closed position and a raised position removed from said base, said trunnion travel surfaces being slidable over said trunnions during rotation of said cover about said trunnions between said closed position and an inclined open position at which said ledge surfaces abut said trunnions to prevent rotation of said cover beyond said open position and said tabs underlie and are engageable with said trunnions to impede vertical removal of said cover from said base, said cover when in said open position providing access to said tube-receiving openings.

2. The tube rack of claim 1, wherein said openings include internal mutually spaced pads, said pads being positioned to support tubes received in said openings, while providing flow paths adjacent to the tubes through which air may pass.

3. The tube rack of claim 1, wherein said pads have chamfered concave surfaces.

4. The tube rack of claim 3, wherein said openings are substantially rectangular and each wall of said opening includes one of said support pads.

5. The tube rack of claim 3, wherein said openings are substantially rectangular and at least two of said facing walls includes one of said support pads.

6. The tube rack of claim 1, further comprising:

first and second slide latches each having a lengthwise tongue; and wherein the sidewalls of said base each include a slide surface comprising a lengthwise groove that slidably mates with one of said lengthwise tongues of an associated one of said slide latches, such that each of said slide latches moves lengthwise over its associated said slide surface between latched and unhatched positions.

7. The tube rack of claim 6, wherein each of said slide latches comprises:

a main body including a top surface having a top projection and an inner sidewall having first and second sidewall projections, wherein said top projection acts to prevent said associated slide latch from being withdrawn too far with respect to its associated said slide surface, and said first and second sidewall projections assist in maintaining their associated said slide latch in its open or closed position.

8. The tube rack of claim 7 wherein said slide latches each include a finger that extends lengthwise from said main body to prevent said cover from being removed from said base when said latch is in its closed position.

9. The tube rack of claim 8, wherein said cover includes first and second bosses located on an interior portion of said cover, said bosses each include a finger passage through which an associated one of said fingers passes to lock the cover in the closed position.

10. The tube rack of claim 9, wherein said bosses form an integral unitary structure with said first and second cover sidewalls.

11. The tube rack of claim 10, wherein each of said bosses includes an associated boss support surface that rests on an associated base support surface when said cover is in the full closed position.

12. The tube rack of claim 1 wherein said downwardly facing openings are larger than the maximum transverse dimensions of said trunnions.

13. The tube rack of claim 1 wherein said tube receiving openings are provided internally with mutually spaced support pads positioned to vertically support tubes received in said openings.

* * * * *